United States Patent [19]

Volpe

[11] 4,003,412

[45] Jan. 18, 1977

[54] WEFT CARRIER POSITIONING DEVICE

[75] Inventor: Richard L. Volpe, Hopedale, Mass.

[73] Assignee: Rockwell International Corporation, Pittsburgh, Pa.

[22] Filed: Sept. 23, 1975

[21] Appl. No.: 615,996

[52] U.S. Cl. ..... 139/449; 139/1 R

[51] Int. Cl.[2] ..... D03D 47/00

[58] Field of Search ..... 139/122 R, 1 R, 380, 139/193, 123, 127 R, 429, 443–449

[56] References Cited

UNITED STATES PATENTS

| | | | |
|---|---|---|---|
| 3,777,787 | 12/1973 | Anderson | 139/127 R |
| 3,779,288 | 12/1973 | Budzyna | 139/122 R |

FOREIGN PATENTS OR APPLICATIONS

| | | | |
|---|---|---|---|
| 394,916 | 12/1908 | France | 139/193 |
| 570,909 | 1/1924 | France | 139/123 |

*Primary Examiner*—James Kee Chi

[57] ABSTRACT

A weft carrier positioning device for shuttleless looms having an elongated hollow body insertable for a portion of its length into the warp shed through the sheet of upper warp threads and into the pathway of a weft carrier. By turning the loom's handwheel a selected carrier fixed on the end of a flexible tape will enter the elongated hollow body and pass through the latter to an accessible position out of the shed and above the upper sheet of warp threads.

3 Claims, 3 Drawing Figures

WEFT CARRIER POSITIONING DEVICE

BACKGROUND OF THE INVENTION

The invention pertains to a weft carrier positioning device for shuttleless looms of the type wherein weft yarn is drawn from a stationary source located externally of the inserting means of the loom. Opposed weft carrier members, fixed on the free ends of flexible tapes that are wrapped about and unwrapped from tape wheels mounted on the sides of the loom, are inserted and withdrawn from sheds formed by warp threads during their function of inserting and extending each pick of weft as is well known to those conversant in the weaving art.

The opposed weft carriers are known generally as the inserting carrier and the extending carrier. The inserting carrier introduces each pick of weft into the shed and at a position approximately the center of the latter it meets and transfers the introduced weft to the extending carrier which is effective in drawing the introduced weft through the remainder of the shed to complete a single pick.

It is a common and frequent practice for loom fixers to stop a loom to inspect both the inserting and extending carriers by separating adjacent warp threads of the upper sheet of warp threads and then carefully guiding the carrier upwardly through this separation thus making it accessible for whatever attention it may require. Frequently nicks or burrs need to be removed which of course would be detrimental to the warp thread. The gripping elements of the carriers may need readjusting or replacement to increase or decrease the gripping force thereof. Additionally carriers which are detachable from their respective tapes or which include replaceable components are brought out of the shed in the manner described for the purpose of making such replacements.

Prior to the instant invention the means employed to guide a carrier out of the shed to a position above the latter was considered quite time consuming as well as dangerous to that person guiding the carrier out of the shed. Two people usually participate in positioning the carrier in an accessible location which requires one person turning the loom's handwheel while the other separates adjacent threads of the upper warp sheet with one hand and with the other grasps and guides the carrier and its tape while it is being advanced by movement of said handwheel. The leading ends of the carrier are relatively sharp and pointed and bodily injury is easily inflicted if the carrier is moved more rapidly or stopped more suddenly than is anticipated by the person guiding the carrier. Another method of extracting a carrier from the shed is that of one person holding the shipper handle with one hand and jogging the loom while with the other hand separating a pair of adjacent warp threads of the upper warp sheet while inserting an implement such as a steel scale for guiding the carrier upwardly through the separation. The latter method is also time consuming and equally dangerous to bodily injury as well as to the warp threads themselves.

The weft carrier positioning device comprising the invention has eliminated the problems described above by providing a means which enables one person to quickly, safely and in a positive manner move a weft carrier out of the shed and to an accessible position above the latter.

SUMMARY OF THE INVENTION

The weft carrier positioning device for shuttleless looms of the present invention includes an elongated hollow body one end of which is insertable between a pair of adjacent threads of the upper warp sheet. That end which is inserted into the shed includes a tongue extending therefrom which is adapted to slip beneath a plurality of warp threads forming the lower warp sheet and is effective in locating the elongated hollow body in a position which places one opening thereof in the pathway of the weft carrier selected to be removed from the shed and the other opening above the upper warp sheet. By simply turning the loom's handwheel the carrier is caused to enter the lower opening of the elongated holllow body, to move upwardly therethrough and to exit at the upper opening which locates said carrier in an accessible position above the warp threads of the upper warp sheet.

It is a general object of the invention to provide an improved means for removing a weft carrier out of a warp shed to an accessible position above the upper warp sheet.

It is a further object of the invention to provide a weft carrier positioning device of simplified construction, inexpensive to manufacture and which will perform its intended function in a positive manner.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
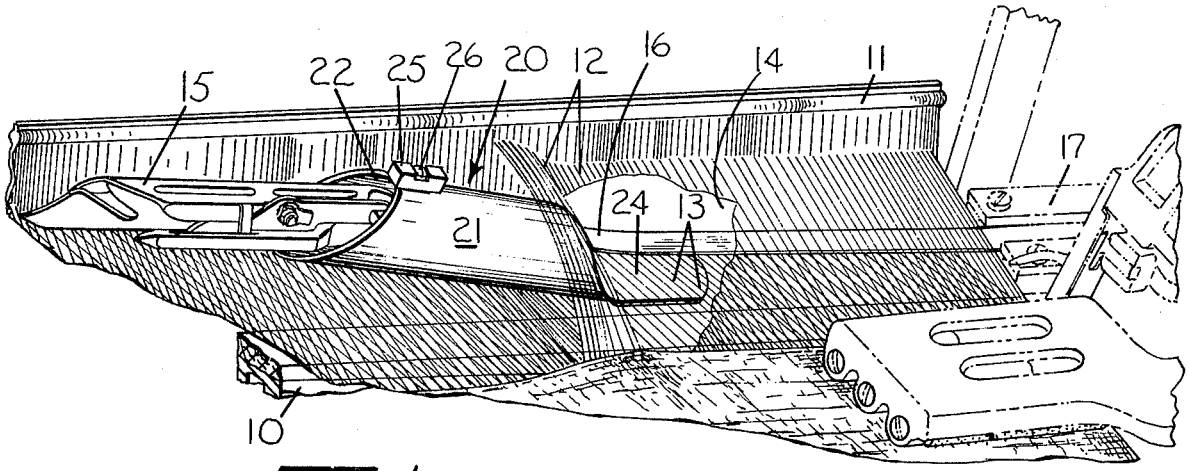
FIG. 1 is a perspective view of a portion of a shuttleless loom showing the device according to the invention associated with the weft inserting carrier.
Figure 3:
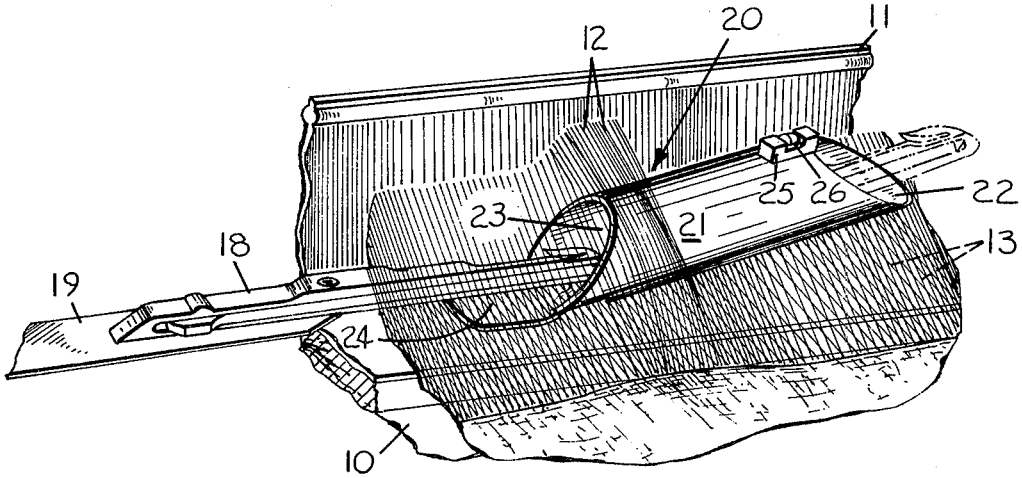
FIG. 3 is a view similar to FIG. 1 but showing the device in position for removing the extending carrier from the warp shed.

Now referring to the FIGS. of drawing enough of a shuttleless loom is shown in FIGS. 1 and 3 to serve as a basis for the detailed description of the invention applied thereto.

In FIG. 1 a portion of the forward upper right hand end of a shuttleless loom is shown and among the various parts thereof there is shown a lay beam 10 with a reed 11 carried thereon through which sheets of warp threads 12 and 13 extend to form shed openings 14 all of which is well known to those conversant in the weaving art. In FIG. 1 the sheet of upper warp threads is identified by numeral 12 and the sheet of lower warp threads by numeral 13.

The inserting carrier is identified by numeral 15 (FIG. 1) and is attached to the free end of a flexible tape 16 which is alternately wrapped about and unwrapped from an oscillating tape wheel (not shown) disposed at the side of the loom.

The usual form of tape guide 17 is fixed to the side of the loom in operative association with the tape wheel and serves to guide the flexible tape 16 and carrier 15 during their movement into and from the sheds 14 formed by the sheets of warp threads 12 and 13.

The extending carrier is identified by numeral 18 (FIG. 3) and is attached to the free end of a flexible tape 19 which like the inserting carrier is guided and actuated by a tape guide and oscillating tape wheel (not shown) disposed on the left hand end of the loom.

Figure 2:
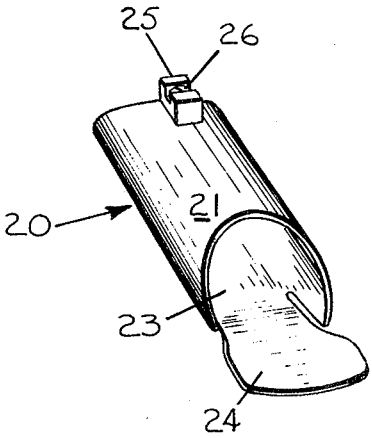
FIG. 2 is a perspective view of the device illustrated in operating position in FIG. 1.

The weft carrier positioning device according to the invention is identified generally in FIGS. 1, 2 and 3 by numeral 20 and includes an elongated hollow body 21 of generally cylindrical configuration which in operating position the ends thereof define upper and lower end openings 22 and 23 respectively. These upper and lower openings 22 and 23 are angularly disposed relative to the longitudinal axis of the elongated hollow body 21 which forms a substantially elliptical configuration to said openings.

The elongated hollow body 21 is provided with a planar surface that defines a tongue 24 which is disposed in operative association with and extends outwardly from one side of the lower opening 23 at an angle to the longitudinal axis of said elongated hollow body.

As shown in FIGS. 1, 2, and 3 the upper surface of the elongated hollow body 21 immediately adjacent to opening 22 has a magnet 25 assembled thereto by means of a screw 26. This magnet serves as a means for retaining disassembled components of a carrier which are relatively small and which are easily dropped or lost while making common and necessary adjustments to or replacements of carriers and components thereof.

To summarize the operation the present invention solves a long standing need for a device which enables an operator or loom fixer, in a positive manner to quickly, easily and above all safely, advance one or the other of the loom's carriers upwardly through the sheet of upper warp threads to an accessible position whereat any necessary attention required by the carrier can be made. To accomplish this one simply directs the tongue 24 between a pair of adjacent warp threads of the upper sheet of warp threads and inserts the elongated hollow body 21 into the warp shed a sufficient distance to enable said tongue to be positioned beneath a plurality of warp threads of the sheet of lower warp threads as shown in FIG. 1 of the drawing. The configuration of the lower opening 23 being generally elliptical provides a tapered end that defines a camming surface at one end of the elongated hollow body which serves to cam the warp threads 12 onto the upper portion of the latter as illustrated in FIGS. 1 and 3 of the drawing. When the device has been positioned as described its lower end opening 23 is located in the pathway of the particular carrier which has been selected to be removed from the warp shed. With the device in this position, the loom's handwheel can be rotated causing the carrier to enter the lower opening 23, pass through the elongated hollow body 21 and exit through the upper end opening 22 to any desired accessible position above the upper sheet of warp threads. The upper end opening 22 having a generally elliptical configuration permits minor adjustments to be made to a carrier while being partially supported within the elongated hollow body 21. Additionally, the magnet 25 provides a means for retaining small components of a carrier such as screws or the like which are easily lost or dropped while making necessary replacements or adjustments to said carrier.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for selectively guiding a weft carrier to an accessible position outside a warp shed in looms of the type in which opposed carriers attached to flexible tapes insert weft yarn from a stationary source of supply within sheds formed by warp threads, said device comprising:

a. means defining an elongated hollow body insertable for a portion of its length between an adjacent pair of warp threads of the upper warp sheet;

b. a camming means forming one end of said elongated hollow body for displacing warp threads of the upper warp sheet during insertion of said hollow body; and c. means extending from said one end of said elongated hollow body for locating the latter in operative association with a plurality of warp threads of the lower warp sheet and in the pathway of the weft carrier.

2. The weft carrier positioning device according to claim 1 wherein said locating means defines a tongue disposed at an angle to the longitudinal axis of said elongated hollow body for positioning the latter at an angle oblique to the direction of movement of the carrier.

3. The weft carrier positioning device according to claim 1 wherein said weft carrier positioning device includes a retaining means for holding disassembled components of a weft carrier moved to an accessible position through said elongated hollow body.

* * * * *